United States Patent [19]

Bonner, Sr.

[11] 4,292,712

[45] Oct. 6, 1981

[54] CARD COILER CAN CHANGER

[75] Inventor: Alvin T. Bonner, Sr., Mauldin, S.C.

[73] Assignee: John D. Hollingsworth on Wheels, Inc., Greenville, S.C.

[21] Appl. No.: 32,550

[22] Filed: Apr. 23, 1979

[51] Int. Cl.[3] ..... B65H 54/80

[52] U.S. Cl. ..... 19/159 A

[58] Field of Search ..... 19/159 A

[56] References Cited

U.S. PATENT DOCUMENTS

| | | | |
|---|---|---|---|
| 3,354,513 | 11/1967 | Fornes | 19/159 A |
| 3,429,009 | 2/1969 | Goodner | 19/159 A |
| 3,808,641 | 5/1974 | Schneider et al. | 19/159 A |
| 4,042,093 | 8/1977 | Fujii et al. | 19/159 A |

*Primary Examiner*—Louis Rimrodt

*Attorney, Agent, or Firm*—Bailey, Dority & Flint

[57] ABSTRACT

A card coiler can changer is illustrated, being generally of the linear type, wherein elongated guide means are provided for use together with power operated means to eject a full can and replace same with an empty can positioned positively beneath a coiler head. A storage position is provided for receiving and positively positioning an empty can preparatory to a subsequent can changing operation. By guiding the empty can along a linear path, causing the full can to be ejected, a return stroke positions the device for receiving and storing another empty coiler can in reserve.

4 Claims, 4 Drawing Figures

Fig. 3.
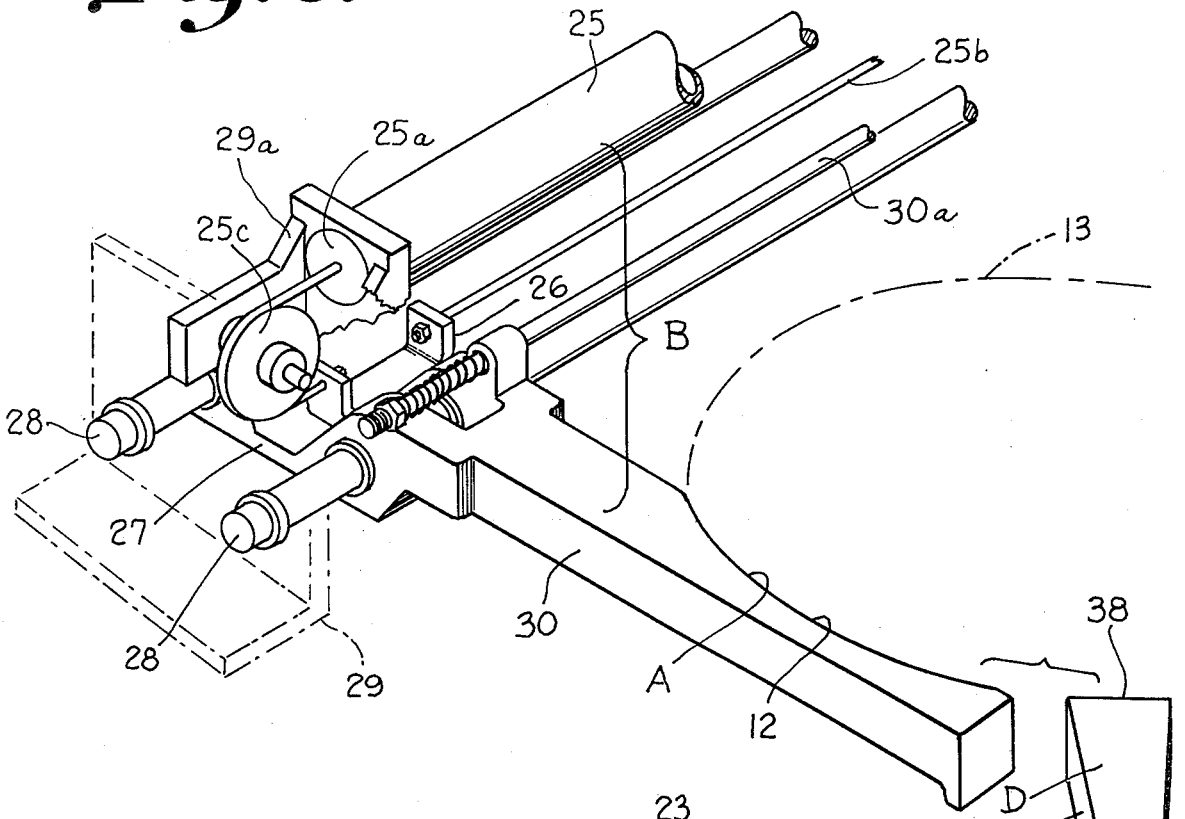
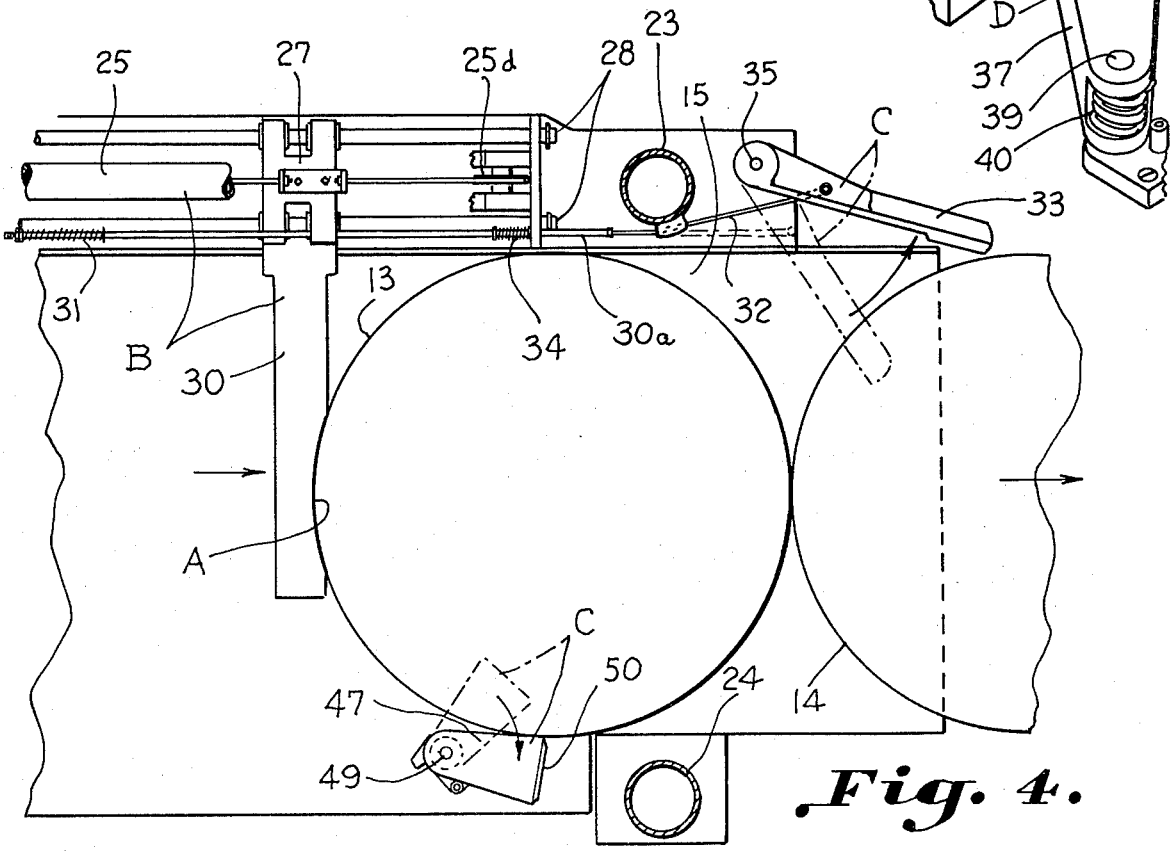
Fig. 4.

CARD COILER CAN CHANGER

BACKGROUND OF THE INVENTION

Prior coiler can changers of the linear type have been severely limited as to reserve can positioning capacity and require replacement of a full can with an empty can upon removal of the full can from beneath the coiler head. One such prior card coiler can changer employs fixed strap retaining means for accommodating two longitudinally spaced cans, one being beneath the coiler head, and the other being in reserve or on standby. Upon filling of the can beneath the coiler head, the strap holding apparatus reciprocates to replace the empty can beneath the coiler head. At this point the full can must be replaced with an empty can preparatory to a reciprocating movement in the opposite direction for full can replacement.

Accordingly, it is an important object of this invention to provide an improved card coiler can changer which will require a minimum of space and yet increase standby capacity while allowing for less demanding attention by the operator.

Another important object of the invention is the provision of an automatic card coiler can changer which positively positions the can beneath the coiler head in proper vertical alignment and fixes same against movement or rotation, such as would disturb the lay or buildup of the sliver in the can.

Another important object of the invention is to provide a can changer which reduces labor requirements since the full can simply awaits its turn to be picked up in the aisle and the replacement can need not be moved into position right after return of the full can removal means after a power stroke.

BRIEF DESCRIPTION OF THE INVENTION

It has been found that an improved automatic card coiler can changer may be provided by utilizing elongated guide means in conjunction with a power operated means which functions automatically on a return stroke, after ejecting a full can and replacing same with an empty can for positively gripping the empty can which has been replaced. Wedging means are provided for facilitating the insertion of an empty can into position adjacent the can placed beneath the coiler head for receiving sliver. The power operated means includes a cable cylinder which moves a carriage. The carriage, after completion of the power stroke, and when the return stroke is almost complete, engages yieldable means for positively gripping the can which has been placed beneath the coiler head. Displaceable wedging means are provided for receiving an empty can in position for subsequent guiding to a position beneath the coiler head while rejecting the full can.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 is an enlarged perspective view of the lower left hand portion of FIG. 1 illustrating the power operated means and guide means for moving an empty can for dislodging a full can and replacing same with the empty can, and FIG. 4 is an enlarged top plan view of the right hand portion of FIG. 2 illustrating the can gripping means in position during ejection of a full can by an empty can.

DESCRIPTION OF A PREFERRED EMBODIMENT

An automatic card coiler can changer apparatus for removing a full coiler can and positively positioning an empty can beneath a coiler head includes guide means A for moving an empty coiler can along a predetermined path to a position beneath a coiler head. Power operated means B are supplied for engaging an empty coiler can on a power stroke thereof and moving same along the predetermined path. The empty coiler can dislodges a full can from a position beneath the coiler can on the power stroke. Gripping means C fix the empty coiler can in the position beneath the coiler head. Wedging means D receives an empty can in a reserve position for engagement by the power operated means when the can positioned beneath the coiler head has received a predetermined amount of sliver. The power operated means yieldably engages the gripping means on a return stroke moving the gripping means into engagement with the empty can positioned beneath the coiler head.

Figure 1:
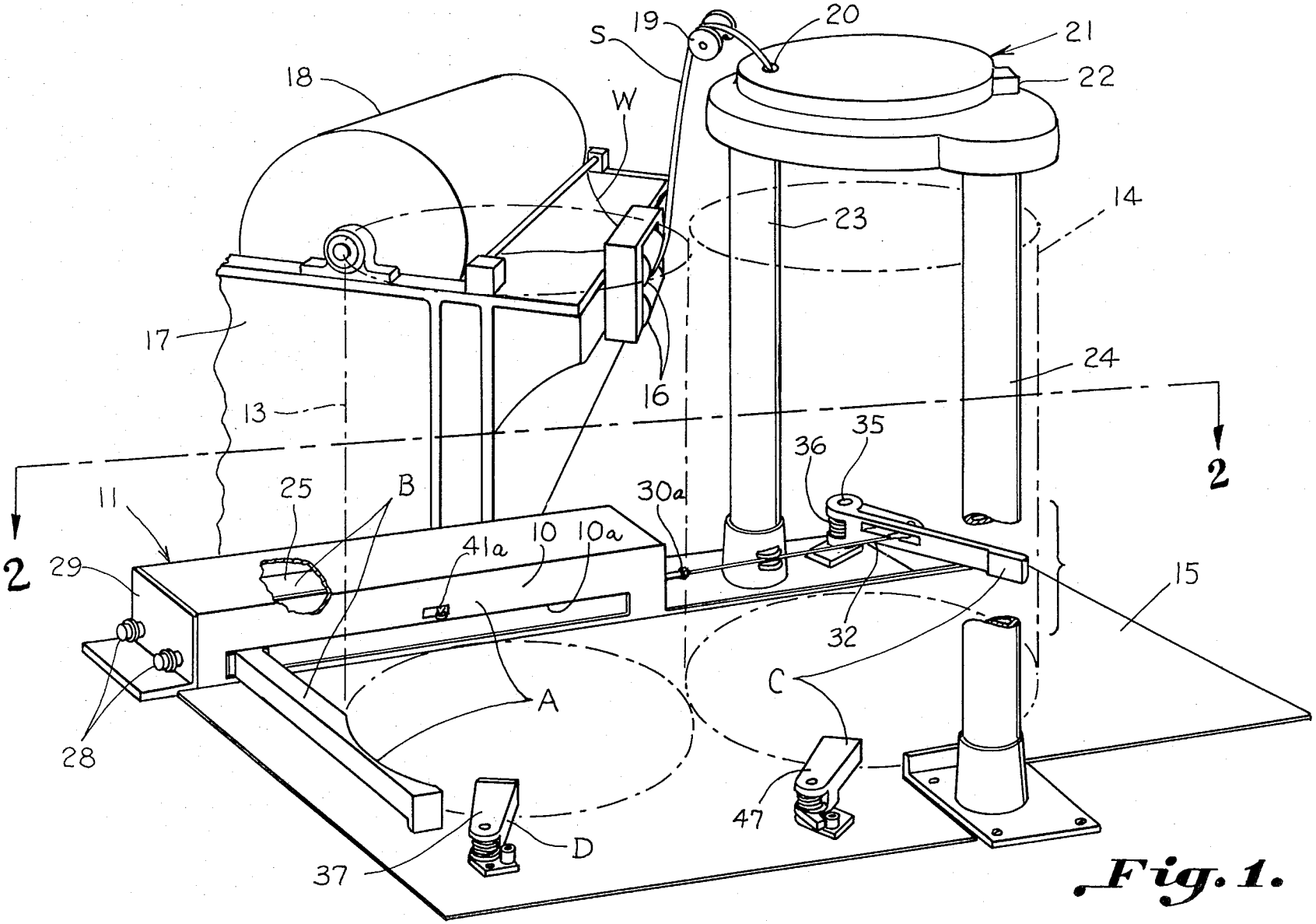
FIG. 1 is a perspective view illustrating an automatic card coiler can changer constructed in accordance with the present invention with a coiler head receiving sliver from a card preparatory to a can changing operation.

The guide means A is illustrated in FIG. 1 as including the elongated inside vertical surface 10 of a cover housing, broadly designated at 11. The guide means A are also illustrated in the drawing as contemplating an arcuate inner surface 12 for engaging an empty coiler can illustrated in broken lines as at 13, for replacing a full can also illustrated in broken lines by the reference character 14. The guide means also contemplates the provision of a base plate 15 which supports various parts of the can changer as well as the can beneath the coiler head and the standby or reserve can.

FIG. 1 illustrates a sliver S being delivered from a card and the like by a pair of calender rolls 16. The calender rolls are carried by suitable card frame members 17. The card is further illustrated as including a doffer 18 for delivering a web W to the calender rolls for forming the sliver S. The sliver S passes over a sliver guide 19 to the opening 20 in the coiler head, broadly designated at 21 for delivery into the can. A suitable means may be provided for signaling when a coiler can is filled with sliver which has been received from the coiler head. This may be provided by any suitable switch mechanism or in the form of any suitable counting mechanism either in connection with the card gearing or rolls, or as schematically illustrated at 22 in connection with a counting mechanism responsive to gearing within the coiler. The coiler head broadly designated at 21, is illustrated as being carried upon spaced standards 23 and 24.

The power operated means B include a cable cylinder 25 carried within the housing 11. The cable cylinder carries within the fixed cylinder portion a piston **25*a* which has connected thereto a cable 25*b* which passes around a sheave 25*c*. The cable 25*b* also passes over the pulley 25***d* at an opposite end for connection to the piston 25*a*. The cable 25*b* carries a connector 26 which is fixed upon a sliding carriage 27. The sliding carriage (FIGS. 2 and 3) is carried for londitudinal sliding movement upon the spaced horizontally disposed sliding rods 28. The sliding rods 28 extend through the upper leg of an angle bracket 29 which supports the housing 11 and the cylinder bracket 29*a*.

The power operated means B further include an outwardly extending arm 30 which extends horizontally outwardly through an elongated slot 10*a* in the vertical wall 10 of the housing 11. The arm 30 carries on an inner face the surface 12 which engages the empty can and acts as a part of the guide means A for moving the empty coiler can into position to dislodge the full can and position the empty can in its place beneath the coiler head 21. It is to be understood that for this purpose the power operated means may be actuated by any suitable means to indicate that the coiler can is full or has received a predetermined amount of sliver.

The arm 30 has fixed connection with the carriage 27. The carriage 27 slides upon the rod 30*a* which is provided with a positioning coil spring 31. When the arm 30 has been moved to the right hand side of the drawings, the gripping means C has been dislodged to dotted line position in FIGS. 2 and 4, and the cable 32 which is attached adjacent the end of the rod 30*a* and at an intermediate point on the gripper portion 33 of the gripping means C, is in tension due to the force of the compression spring 34. Upon the return stroke of the power means, the arm 30 is returned to solid line position in FIG. 2 and the gripper 33 is resiliently urged into resiliently engaging position with the coiler can 14 which is positively positioned beneath the coiler head.

Figure 2:
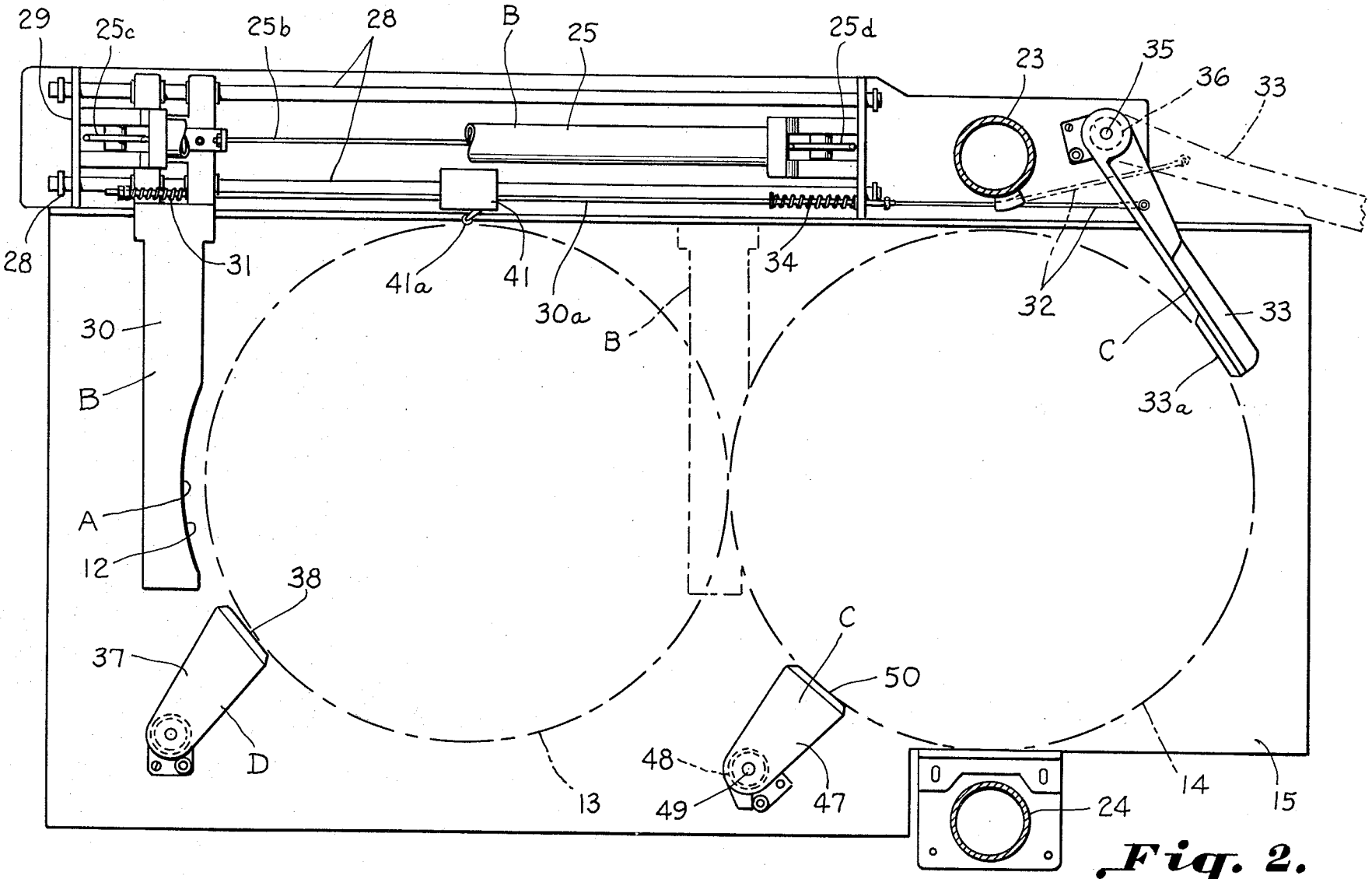
FIG. 2 is a top plan view further illustrating the can changer of FIG. 1.

In this connection, it is important to note that the gripping means C has its arm or gripper 33 pivoted as at 35 and a coil spring 36 is provided for resiliently yielding permitting dislodgement of the arm into broken line position in FIG. 2. The wedging means D for receiving an empty can includes a link member 37 having a wedging surface 38 adjacent the free end thereof normally biased in the direction of the arrow in FIG. 4 about the pivot point 39 as by the coil spring 40. Dislodgement is a result of ejection of the full can 14.

After the power operated means has moved the arm 30 to solid line position at the left hand end of FIG. 2, the link 37 pivots outwardly permitting an empty can to be inserted against the surface 38 and then wedged into place as the can is pushed against the guide surface 10. Moving the can against the guide surface 10 engages a switch 41 which has a can engaging actuator 41*a* extending through the vertical guide wall 10 into engagement with the can. Closing the switch 41 operates to open the circuit to a suitable signaling device such as a lamp (not shown). The switch 41 also stops the card through any suitable apparatus and circuitry if an empty can has not been inserted within a predeteremined time after doffing of the full can.

The gripping means C has a complimentary arm 47 which is similar to the arm 37 and which is provided with a coil spring 48 normally biasing same in the direction of the arrow in FIG. 4 about the pivot point 49. A wedging surface 50 maintains the can in fixed or locked position between the gripping surface 50 and the gripping surface 33*a* of the arm 33.

While a preferred embodiment of the invention has been described using specific terms, such description is for illustrative purposes only, and it is to be understood that changes and variations may be made without departing from the spirit or scope of the following claims.

What is claimed is:

1. Automatic card coiler can changer apparatus for removing a full coiler can and positively positioning an empty can beneath a coiler head comprising:

guide means for moving an empty coiler can along a predetermined substantially linear path to a position beneath a coiler head;

power operated means engaging an empty coiler can on a power stroke thereof and moving same along said predetermined path;

said empty coiler can dislodging a full can from position beneath said coiler can on said power stroke;

gripping means fixing said empty coiler can against rotation in said position beneath said coiler head; and wedging means receiving an empty can in a reserve position wedged against said guide means for engagement by said power operated means when the can beneath the coiler head has received a predetermined amount of sliver.

2. The structure set forth in claim 1 wherein said power operated means on a return stroke yieldably engages said gripping means moving said gripping means into engagement with the empty can positioned beneath the coiler head.

3. The structure set forth in claim 1 wherein said power operated means is a cable cylinder, and including a slidably mounted carriage supporting said arm.

4. The structure set forth in claim 3 including a yieldable connection between said cable and said gripping means.

* * * * *